US005951225A

United States Patent [19]

Osterle et al.

[11] Patent Number: 5,951,225

[45] Date of Patent: Sep. 14, 1999

[54] LARGE-AREA WASHER

[75] Inventors: Helmut Osterle, Feldkirch, Austria; Stefan Baumgartner, Alstatten, Switzerland

[73] Assignee: SFS Industrie Holding AG, Heerbrugg, Switzerland

[21] Appl. No.: 08/656,292

[22] PCT Filed: Dec. 5, 1994

[86] PCT No.: PCT/EP94/04036

§ 371 Date: Jul. 26, 1996

§ 102(e) Date: Jul. 26, 1996

[87] PCT Pub. No.: WO95/16086

PCT Pub. Date: Jun. 15, 1995

[30] Foreign Application Priority Data

Dec. 10, 1993 [DE] Germany ..... 43 42 260

[51] Int. Cl.[6] ..... F16B 43/02

[52] U.S. Cl. ..... 411/545; 411/531; 52/410

[58] Field of Search ..... 411/533, 531, 411/480, 545, 160, 161; 52/410, 408

[56] References Cited

U.S. PATENT DOCUMENTS

| | | | |
|---|---|---|---|
| 3,544,053 | 12/1970 | Ingalls | 411/531 |
| 4,095,430 | 6/1978 | Hannan | 411/531 |
| 4,445,808 | 5/1984 | Arya | 411/531 |
| 4,476,660 | 10/1984 | Francovitch . | |
| 4,763,456 | 8/1988 | Giannuzzi . | |
| 4,781,503 | 11/1988 | Bogel . | |
| 5,069,589 | 12/1991 | Lemke | 411/533 |
| 5,102,275 | 4/1992 | Hulsey | 411/533 |
| 5,445,477 | 8/1995 | Calandra | 411/531 |

FOREIGN PATENT DOCUMENTS

| | | | |
|---|---|---|---|
| 0300963 | 1/1989 | European Pat. Off. . | |
| 0307647 | 3/1989 | European Pat. Off. . | |
| 0344523 | 12/1989 | European Pat. Off. . | |
| 0484084 | 5/1992 | European Pat. Off. . | |
| 1186464 | 4/1970 | United Kingdom | 411/531 |

*Primary Examiner*—Flemming Saether
*Attorney, Agent, or Firm*—Helfgott & Karas, PC

[57] ABSTRACT

In the large-area washer with an aperture for fastener means, there are engagement components on the surface in the fastening direction of the washer. The engagement components engage a cover strip that is to be fastened. The washer also has stiffeners in the form of beads. Unreinforced corner regions of the washer lie radially outside the stiffeners relative to the aperture and can be elastically resiliently bent about an imaginary line at an acute angle to two central axes of the washer. Engaging components may be formed in these corner regions.

17 Claims, 4 Drawing Sheets

LARGE-AREA WASHER

Figure 1:
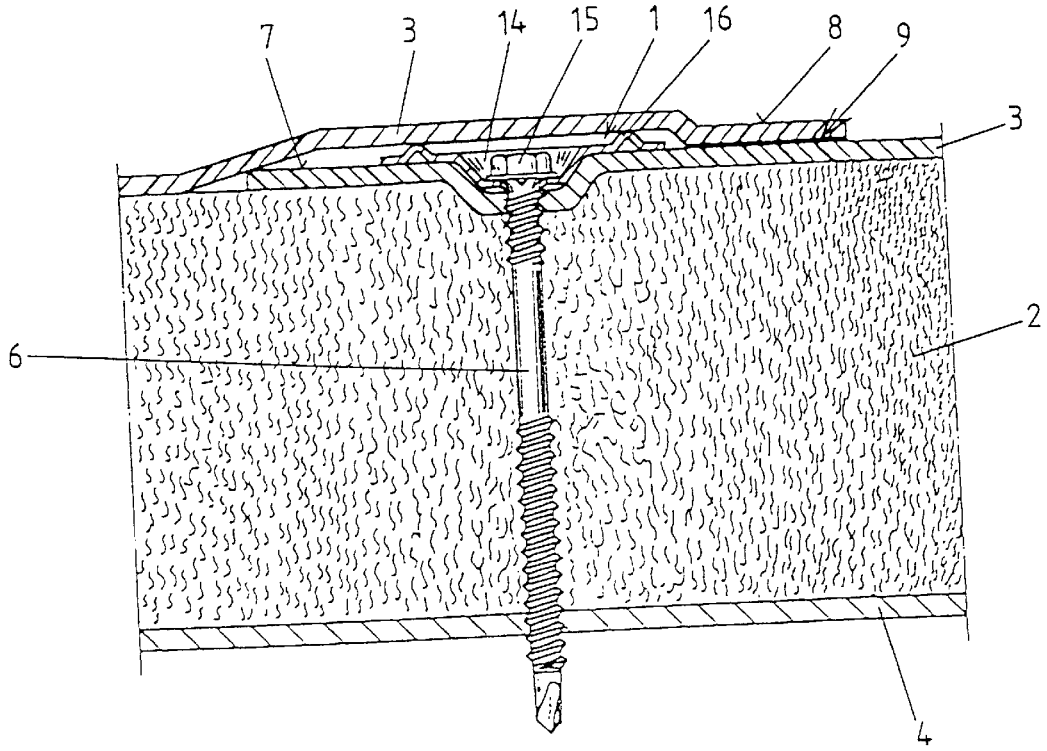

The invention relates to a large-area washer with an aperture for insertion of a fastener, with stiffeners such as reinforcement indentations or beads and/or reinforcement elevations or ribs being formed on the washer.

Such washers, which are known from U.S. Pat. No. 4,763,456 and from U.S. Pat. No. 4,787,188, are used for fastening roofing sheets with one or more layers and/or an insulation layer to a solid infrastructure. In order to achieve a corresponding hold of the covering roofing sheet, the washer known from U.S. Pat. No. 4,763,456 has points as meshing elements, which bore into the roofing sheet, and the washer known from U.S. Pat. No. 4,787,188 has teeth, which do not bore through the roofing sheet, but only increase the friction between the washer and the roofing sheet. Relatively high forces occur between the roofing sheets and the bottom of the washers, particularly if strong forces occur on the roofing sheet due to corresponding suction stress, which forces attempt to pull the roofing sheet out from under the fastener and/or under the washer.

Furthermore, it has always proved to be a problem that, with a corresponding suction stress on the roofing sheets, they are lifted practically in the axis direction of the fastener used, with a correspondingly great force. Since the large-area washers have a limited area, for one thing, the corner regions of the washers, in particular, engage relatively strongly with the sheet material. Particularly, if a firm hold is achieved between the bottom of the washer and the roofing sheet and thus the roofing sheet cannot be pulled out from under the washer, there is greater stress in the corner regions of the washer when the roofing sheet is lifted, so that it has happened repeatedly that these corner regions of the washers, in particular, cause damage to the roofing sheet.

In the known embodiments, attention has been paid, repeatedly, to making reinforcement or stiffening elements available particularly in the edge region, in order to be able to distribute the force proceeding from the fastener over a relatively large surface and in a reliable manner. But at the same time, this creates the risk that the corner regions of the washer will press into the sheet to be fastened, if there is too much stress, and can damage it.

It is therefore an object of the present invention to create a large-area washer, with which damage of roofing sheets in the corner region of the washer can be avoided.

Pursuant to the invention, it is proposed, for this purpose, that the corner regions of the washer be arranged outside of the segments, which have the stiffeners, and can be elastically bent down about an imaginary line at an acute angle to the two central axes of the washer as far as a given load region.

If, therefore, suction forces cause undue stress on the roofing sheet and therefore lift it from the insulation underneath, the corner regions of the washer have the possibility of moving in the elastic range, in order thereby to prevent damage to the roofing sheet. If a really excessive force should attack at some time, then it would also be conceivable, and this possibility exists, that the corner regions undergo plastic deformation. This provides at least a corresponding safety factor, which also takes into consideration cases with a particular storm effect. With the wind stresses, which usually occur, the corner regions can bend elastically and subsequently always return to their original position.

Furthermore, it is proposed that to improve the friction and/or the meshing, a coating be provided and/or protruding elements be constructed in the corner regions at the surface.

Since corresponding elements to improve the friction and/or the meshing are formed in these corner regions, the necessary friction or the necessary meshing between the bottom of the washer and the top of the roofing sheet is always maintained, even when corresponding elastic bending of the corner regions occurs.

With the present invention, particularly that region of the large-area washer, which always caused special problems with possible damage to the roofing sheets, can be improved significantly.

In a particular embodiment, the bendable corner regions of the washer are formed in that the boundary of the stiffeners facing towards the outside edge runs at an acute angle to both side boundaries, which face one another, at least in the corner regions of the washer. Therefore a flat, large region, which can be bent elastically, is formed specifically outside the stiffeners.

In accordance with a particular embodiment, it is provided that the stiffener is formed as a reinforcement bead with a closed circumference, which surrounds the center aperture in the washer and which runs at an acute angle to both center axes in the corner regions of the washer. This guarantees that the stiffener comes close to the surrounding edge of the washer, seen in the axis direction in each instance, in order to thereby properly distribute the fastening forces over the length and the width of such a washer. At the same time, the possibility is also created that the corner regions remain elastic and not reinforced, so to speak.

An advantageous further development specifically in connection with the elastically bendable corner regions is possible if the washer is formed in a known manner, as a rectangle or square with rounded corners, or as an ellipse. With these shapes of washers, there is always the risk that the corner regions will be pressed in; for an ellipse, this refers to the transition region between the larger and the smaller arc segment.

Particularly to improve the meshing of the washer in the roofing sheet, it is practical to provide a corresponding number of meshing elements. In the present invention, it is conceivable that meshing elements are formed both in the corner regions and within a segment enclosed by a stiffener bead. This means that corresponding elements to improve the friction and/or the meshing can be arranged so as to be distributed over a relatively large area, so that particularly great friction or particularly good meshing between the washer and the roofing sheet is guaranteed.

In an appropriate embodiment, the stiffeners point counter to the fastening direction, the flat corner regions and the segments of the washer which lie between the stiffeners, with the exception of the region with the aperture, being aligned in a common plane, which lies below the stiffeners. This embodiment guarantees particularly good meshing of the meshing elements, since practically all the meshing elements project downward from level contact on the roofing sheet. This is possible because the stiffeners are directed upward from the main plane of the washer.

In order to achieve particularly good meshing between the washer and the roofing sheet, it is appropriate if two or more than two meshing elements in the form of points, teeth, projections or something similar are provided in the corner regions of the washer, with at least two or three such meshing elements being aligned in a row, which runs parallel to the imaginary line for elastic bending of the corner regions. If elastic bending of such a corner regions comes about, there is always the guarantee that full meshing between the bottom of the washer and the roofing sheet is present over the entire length, corresponding to the imaginary bending line, since these meshing elements arranged in a line are always aligned parallel to this imaginary bending line.

Another practical variant for a washer in the inventive sense provides that the washer is made from spring steel in sheet form. Specifically with such an embodiment, a large bending region in the corner regions of the washer can be achieved, even when relatively large suction forces act on the roofing sheet, without any plastic deformation of the washer coming about.

Figure 2:
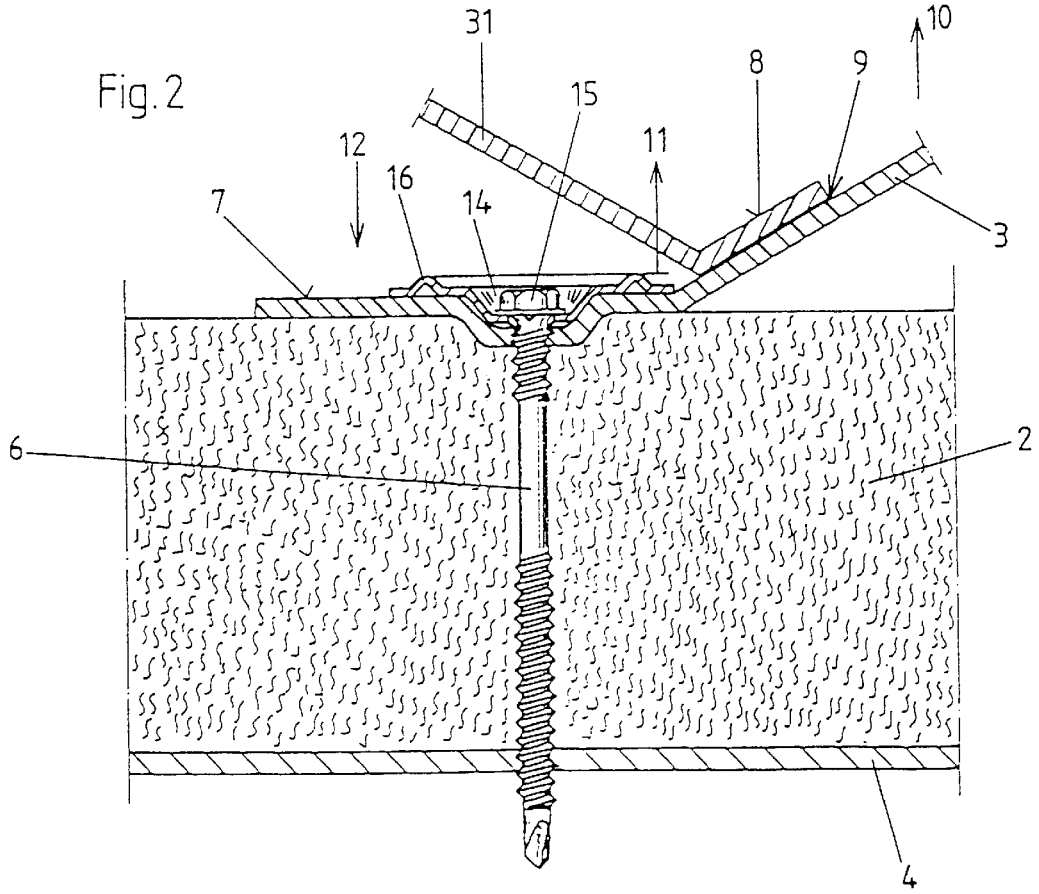
Figure 4:
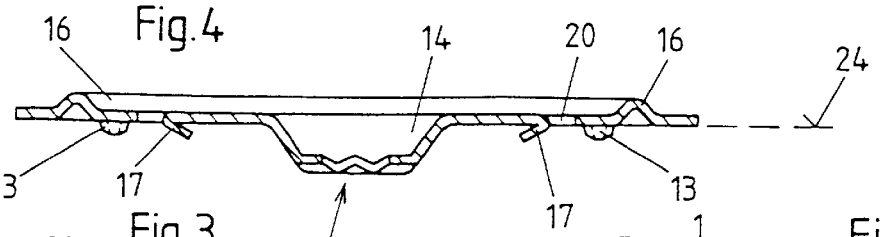
Figure 3:
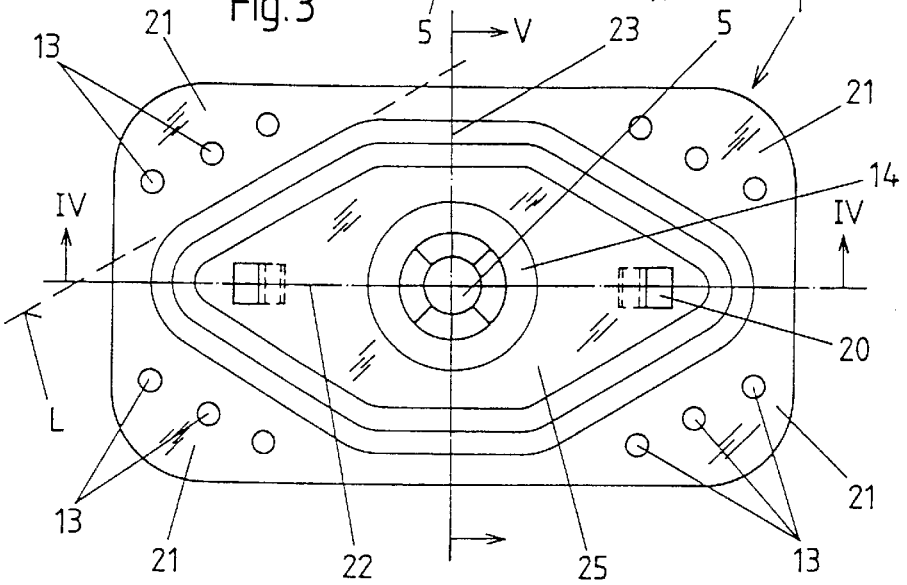
Figure 5:
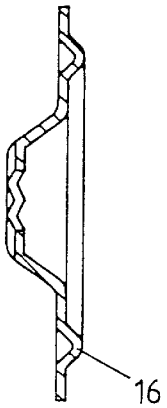
Figure 8:
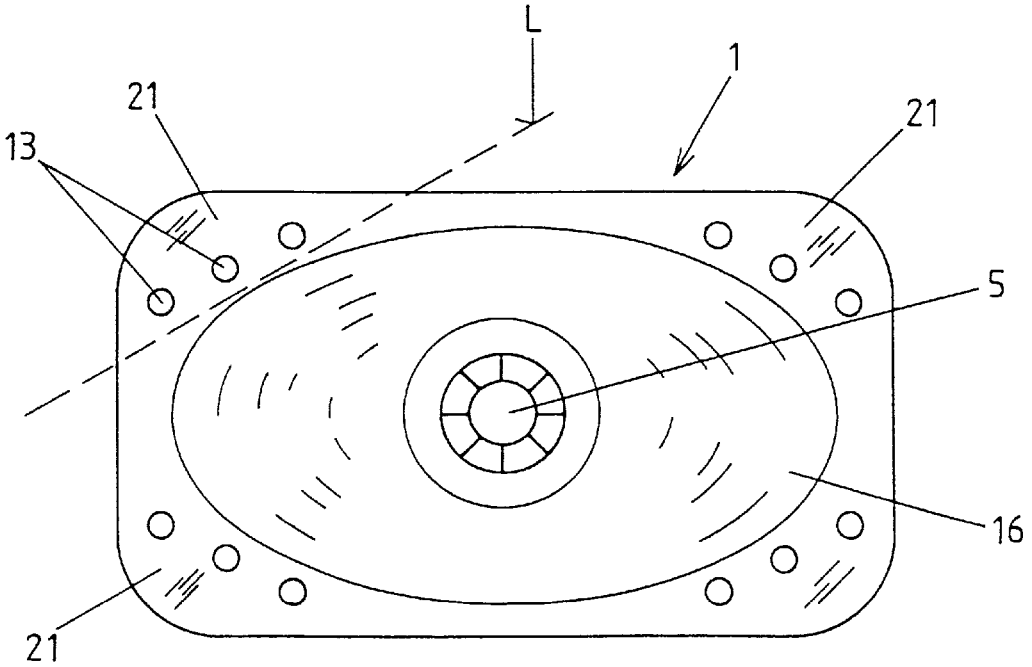
Figure 9:
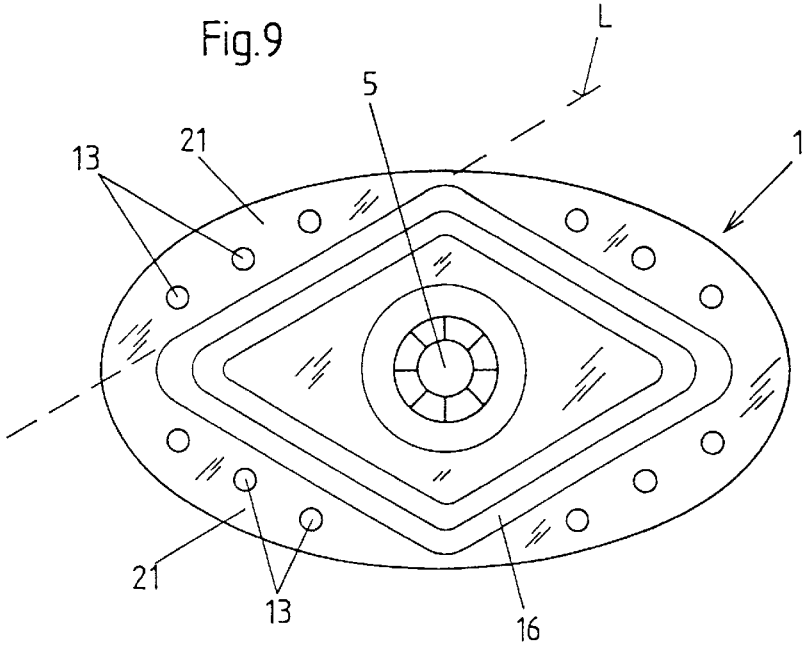
Figure 11:
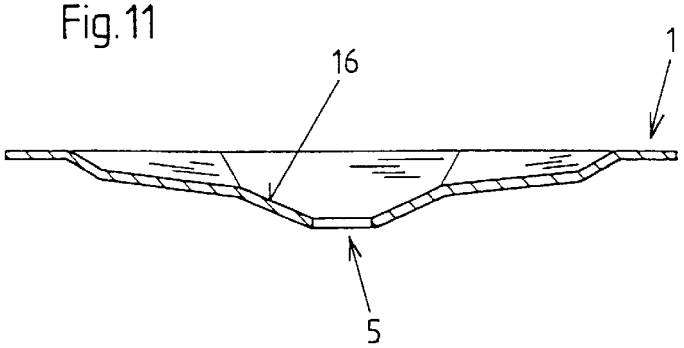
Figure 10:
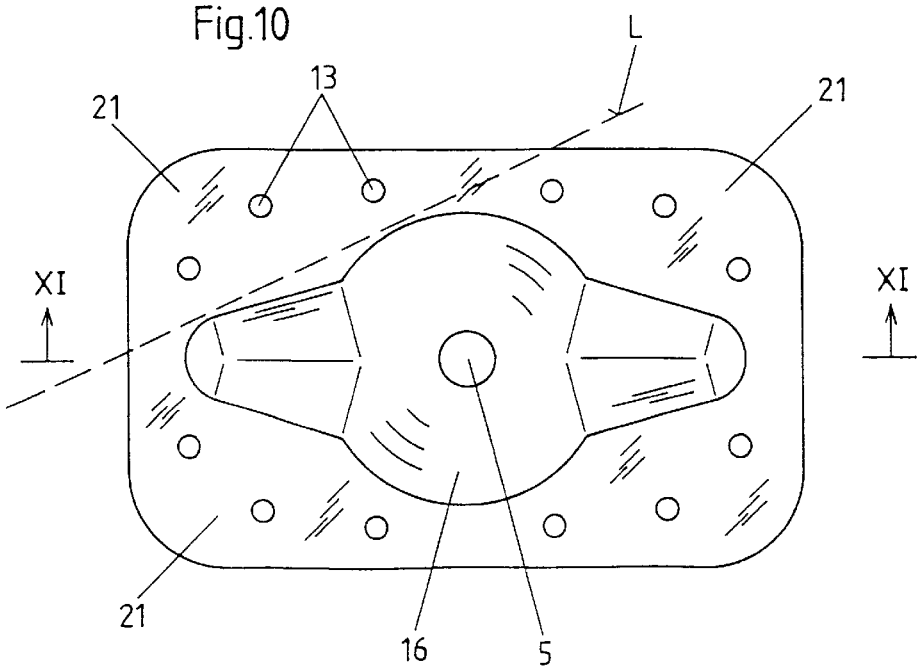

Further characteristics and particular advantages will be explained in greater detail below by means of the drawings, in which FIG. 1 shows a cross-section through an example of a large-area washer for fastening insulation layers and roofing sheets, FIG. 2 shows the same case as FIG. 1, but with corresponding forces acting on the roofing sheet, FIG. 3 shows a large-area washer in plan view, FIG. 4 shows a section along the line IV—IV of FIG. 3, FIG. 5 shows a section along the line V—V of FIG. 3, FIG. 6 to FIG. 10 shows various embodiments of washers, each in plan view, and FIG. 11 shows a section along the line XI—XI of FIG. 10.

A large-area washer 1 is used to attach an insulation layer 2 and a roofing sheet 3, which covers it, to a fixed infrastructure 4. A fastener 6, in this case a screw, is inserted into a center aperture 5. The roofing sheet 3 is always fastened at an edge region 7, where the edge region 8 of the next roofing sheet 3' covers the locations where screws are placed. The roofing sheets 3 and 3' are then glued or bonded together in the region 9. The fastening location itself has therefore come into a region which is sealed towards the outside.

If the roofing sheets 3, 3' are now pulled upward by corresponding suction forces, which act in the direction of the arrow 10, as shown in FIG. 2, then corresponding forces act on the screw connection and particularly also on the washer 1. The region of the washer 1, which is on the right in the drawing, is pulled upward in the direction of the arrow 11, while the region of the washer 1, which is on the left in the drawing, is pushed downward in the direction of the arrow 12. Now this edge region of the roofing sheet 3 should be held securely under the washer 1 under the action of such extreme forces. Furthermore, damage to the roofing sheet 3 resulting from this extreme indentation of the edge and corner regions of the washer 1 is to be avoided already because of the indented corner region.

An embodiment of a particular washer 1 is explained in greater detail using FIGS. 3 to 5. In the case of an essentially rectangular washer 1, the aperture 5 for receiving the fastener 6 is formed in a corresponding depression 14, the depression 14 serving to hold the head 15 of the fastener. On the washer 1, several meshing elements 13 are provided, which protrude from the bottom of the washer 1 and thereby guarantee an increase in the friction relative to the roofing sheet 2 underneath, or a corresponding meshing with this roofing sheet 3. In order to achieve a corresponding stiffening of the washer 1 and to bring the forces of the screw to the respective edges in the region of the center axes, stiffeners 16 are provided. In FIG. 3 and 4, brackets 17 are evident, which are punched out of an aperture 20 and bent downward. These brackets 17 can serve as spacers, if a large number of washers 1 are stacked above one another for storage, and in order to allow a rotational or shifting movement.

If the stress for such a large-area washer 1 is considered, in particular, then it is evident that the corner regions 21, referring to the information in FIG. 2, will be strongly indented into the sheet 3 underneath, in the tension region 11 and in the compression region 12. The tension region 11 is always under more extreme stress, because the segment of the roofing sheet 3, which is located there, can lift to a greater extent between the individual fastening locations.

In accordance with the following description, it is now provided as an essential measure that the corner regions 21 of the washer are disposed outside of the segments, which have the stiffeners 16; in other words, the corner regions 21 do not have any particular stiffening due to reinforcement indentations or beads and/or reinforcement elevations or ribs. It is therefore possible that these corner regions 21 can be bent down elastically about an imaginary line L at an acute angle to the two imaginary orthogonal central axes 22 and 23 of the washer 1 as far as a given load region. Therefore, as long as forces occur, which do not exceed the elastic bending range of the corner regions 21, the corner regions 21 are elastically resilient and can therefore follow correspondingly with changing load occurrences. In an extreme load case, there is furthermore the possibility, so to speak as a safety factor, that the corresponding corner region 21 can also undergo plastic deformation, in other words be bent down around the imaginary line L to such an extent that it can no longer return to its original position. Since corresponding meshing elements 13 are always provided specifically in the corner region 21 of the washer, equally good meshing between the bottom of the washer 1 and the roofing sheet 3 is always guaranteed, independent of any possible elastic bending of the corner regions 21.

In the case of this embodiment, the stiffener 16 is formed as a peripherally closed reinforcement bead, which surrounds the center aperture 5. On the two long sides, a small straight-line segment is provided in each instance, with the stiffener 16 running at an acute angle to the two center axes 22, 23, in the direction of the corner regions, in other words also in the direction of the narrow sides of the washer 1, which lie opposite one another. The necessary force distribution to the edges, in other words over the entire length and width of the washer, is guaranteed by the special arrangement of the stiffeners 16, the corner regions 21 nevertheless remaining elastically bendable. In the embodiment of FIGS. 3 to 5, meshing elements 13 are formed only in the corner regions 21, in other words outside of the segment enclosed by the stiffener 16. However, it is certainly conceivable, particularly if the washer has a correspondingly large area, to provide corresponding meshing elements 13 also in a segment located within a stiffener.

Especially for an embodiment of FIGS. 3 and 5 and also for some other embodiment variations, the stiffeners 16 face upward opposite to the fastening direction, in other words up from the plane 24, which passes through the main part of the washer. With the exception of the region of the depression 14 with the aperture 5, the flat corner regions 21 and the segments 25 located between the stiffeners 16 are aligned in this common plane 24, which lies below the stiffeners 16. In every embodiment described and illustrated herein, the corner regions are joined together as portions of a continuous external perimeter of the washer. The external perimeter has its surface aligned in the common plane (24 in FIG. 4).

From FIG. 3, it is evident that three meshing elements 13 are provided in each of the corner regions 21; they are aligned in a row, which runs parallel to the imaginary line L for elastic bending of the corner regions 21. This specifically guarantees a powerful meshing of the washer with the roofing sheet, which is to be fastened, specifically at a slight distance from the imaginary bending line. Of course, additional meshing elements 13 can also be provided outside of this row, which could also consist of only two of such meshing elements 13, if this appears practical on the basis of the size and the particular formation of the corner regions 21.

Figure 6:
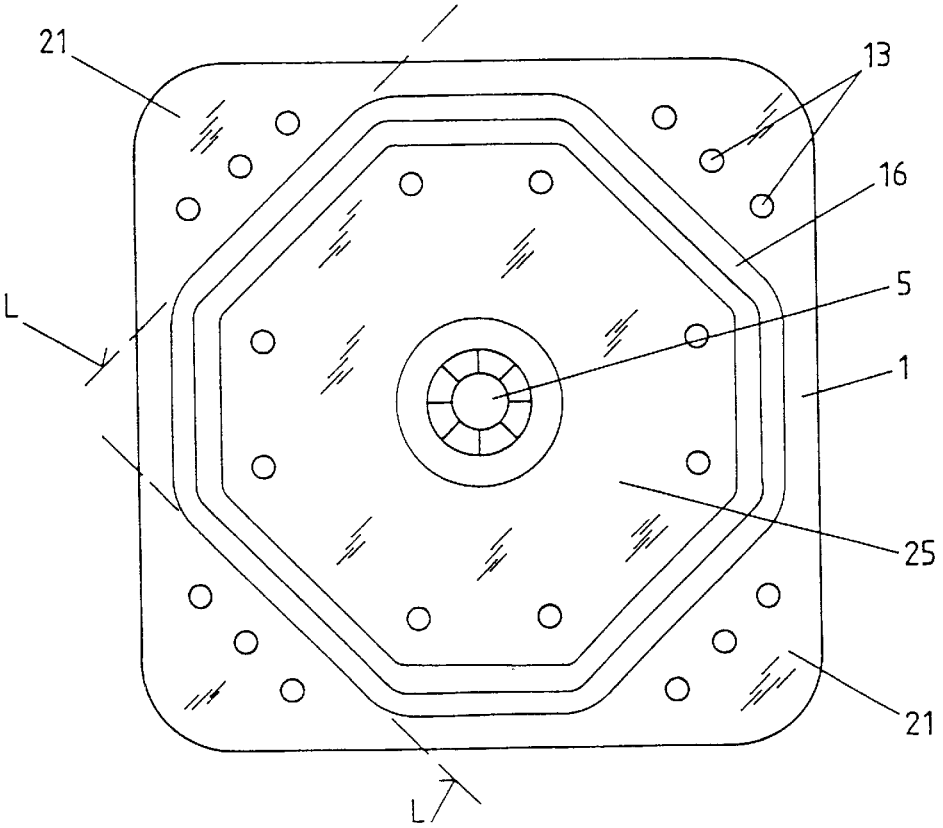
Figure 7:
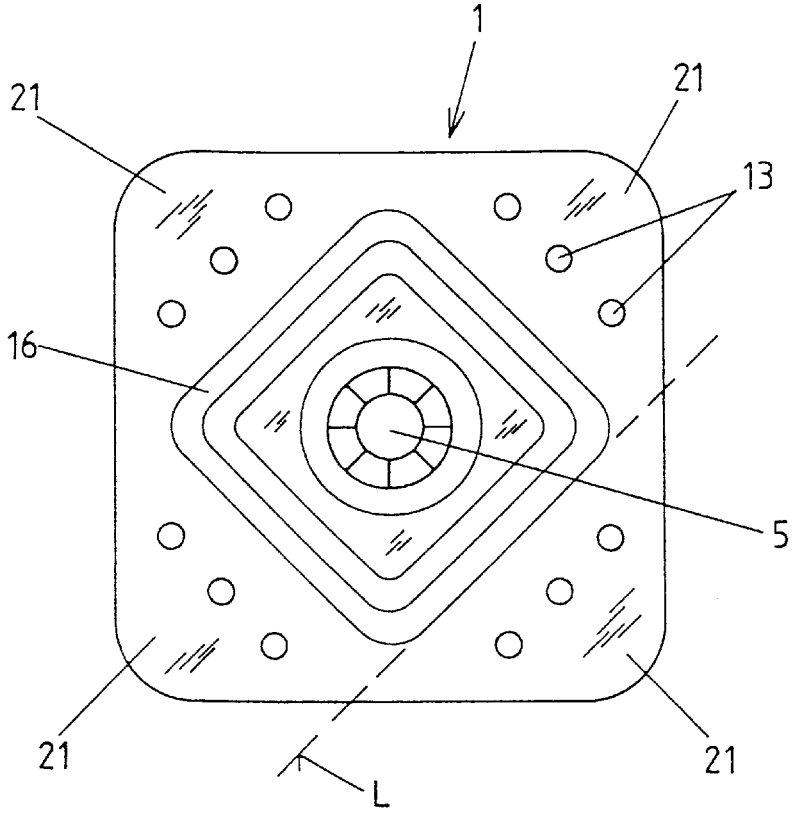

For the embodiment of FIG. 6, an essentially square washer is provided, in which the stiffeners are arranged in form similar to that of FIG. 3, but where linear segments of the stiffeners 16 are present at all edge regions. Particularly in this embodiment, meshing elements 13 are also present in the segment 25 provided within the stiffeners 16.

In the embodiment according to FIG. 7, again an approximately square washer is shown in a plan view, here also, the stiffeners extending square and peripherally closed, offset by 90° relative to the edge regions of the washer. This results in somewhat enlarged corner regions 21, so that the imaginary bending line L indents even further towards the center. Such an embodiment is particularly practical if susceptible roofing sheets are used and if relatively large elastic bending is possible on the basis of the specific material of the washer.

For the embodiment of FIG. 8, it is evident that a similar design with elastically bending corner regions 21 is also possible if the reinforcements are formed not by beads or something similar, but rather, as in this embodiment, by a convexly curved segment of the washer. In this manner also, the reinforcement is brought from the fastening location close to the longitudinal or side edges of the washer 1, the corner regions nevertheless remaining free from additional stiffeners. These corner regions 21 can therefore be correspondingly elastically bendable, there being the additional measure that corresponding meshing elements 13 must be present specifically in this region.

The embodiment of FIG. 9 is concerned with a washer, which is elliptical in plan view, the arrangement of the stiffeners 16 in this case being similar to the form shown in FIG. 3. When corner regions 21 are mentioned in connection with an elliptical washer, this refers to the corresponding transition regions between the wider and the narrower arcs on the long and narrow sides of this washer.

For the embodiment of FIGS. 10 and 11, it is evident that the same arrangement is also possible for washers 1, in which the stiffeners are formed as large-area indentations, which furthermore point in the fastening direction. Corner regions 21 are formed also with such an embodiment; these are provided with corresponding meshing elements 13, these corner regions being elastically bendable along imaginary lines L.

It is, of course, possible to use large-area washers of different external shapes for the purpose described here. From the drawings, it is evident that the washers are rounded off with a relatively large arc in their corner regions 21. Specifically with the measures described here, it would now be possible to vary the radius of this corner formation, particularly since the indentation stress, which was always a significant criterion until now, has essentially been eliminated. Therefore, a correspondingly smaller radius could also be provided for the transition in the corner regions 21 of the washer 1.

The measures described here can be used for large-area washers, no matter whether these are made of metal or plastic. In the embodiment made of plastic, damage to the roofing sheet can also occur due to corresponding stiffening directly up to the corner region of a washer. The structure described here would therefore be particularly advantageous also for plastic washers. In a metal version, it would be advantageous to use a spring steel, which would make it possible to enlarge significantly the range in which the corner regions can be bent elastically. The corner regions 21 are free of such stiffeners, so that they can be bent elastically. Therefore it would be conceivable to use any type of reinforcing indentation or bead and/or reinforcing elevation or rib. Particularly when plastic is used, construction will frequently have appropriate ribs or material accumulation or be of different thicknesses, etc.

In the description above, it has been assumed, on the basis of examples, that meshing elements are arranged or formed at the underside of the washer in the region of the elastically bendable corner regions. The elastically bendable corner regions are, or course, also advantageous for washers, which have no meshing elements at all or, for example, if there are no meshing components only in these corner regions. The elastically bendable corner regions in themselves also bring about essentially new technical effects as compared to the former versions of large-area washers and these effects represent particular progress.

No particular explanation has been given concerning the type of meshing elements. Meshing elements in the form of points, teeth, projections or something similar can be provided. It is also possible, however, to provide meshing elements in the form of a corresponding coating on the underside of the washer, such a coating having a friction-increasing effect. With such a coating, various inclusions to increase the friction further can also be provided.

For the example of FIGS. 1 and 2, a fastening is shown in the seam area between two abutting roofing sheets. Almost always an edge region is fastened here and the edge region of the next roofing sheet then overlaps this fastening site. The large-area washer described here could also be used, however, for a fastening outside of this overlapped seam, in other words for a free field fastening, if additional design elements are added, in which case appropriate sealing elements would have to be provided. For stress reasons alone, and on the basis of the possibility of elastic bendability of the edge regions, the optimum advantages for field fastening are the same as for fastening in the seam region.

We claim:

1. A large-area washer for roofing and insulation applications, comprising:

a generally planar surface area defining an entire perimeter of said washer and having a central aperture for inserting a fastener therethrough, a pair of imaginary orthogonal axes centered at said aperture and dividing said surface area into imaginary quadrants;

stiffeners including at least one of reinforcing indentations, elevations, beads, and ribs on said washer surface area, said stiffeners being at least one of generally straight and generally ovoid;

said stiffeners defining corner regions disposed radially outside said stiffeners relative to said aperture, at least one said corner region being in each said quadrant, when said washer is stressed each said corner region bends elastically about an imaginary line that is at acute angles to said axes of said washer surface areas and when said stiffener is straight, said imaginary line being generally parallel to an associated straight stiffener and defining one of a generally triangular corner region and a chordal segment corner region, and when said stiffener is generally ovoid said imaginary line is generally tangent to an associated ovoid stiffener that defines said corner region.

2. The washer of claim 1, wherein said stiffeners are a peripherally closed reinforcement bead, which surrounds the aperture and are generally parallel to said imaginary line in the corner regions of the washer.

3. A washer as in claim 1, wherein at least one of a coating and protruding meshing elements are on said surface area to increase friction, said coating and meshing elements facing in a fastening direction of said washer.

4. A washer as in claim 3, wherein said meshing elements are located in said corner regions and within a closed periphery formed of at least one of said stiffeners.

5. A washer as in claim 1, wherein said washer is defined by an outer edge, said stiffeners in said corner regions each being at an acute angle with said outer edge.

6. The washer as in claim 1, wherein the washer surface area is one of rectangular with rounded corners and an ellipse.

7. A washer as in claim 6, wherein said rectangular surface area is a square with rounded corners.

8. A washer as in claim 1, wherein said stiffeners and a region surrounding said aperture are in respective planes located away in opposite directions from a common plane of said washer surface area, said corner regions being substantially in said common plane, and a region between said stiffeners and said aperture lying substantially in said common plane.

9. The washer as in claim 1, wherein two or more protruding meshing elements are provided in said corner regions, at least two said meshing elements being aligned in a row that runs parallel to said imaginary line.

10. The washer as in claim 1, said washer being one of metal and plastic.

11. A washer as in claim 1, wherein said corner regions are flat.

12. A washer as in claim 1, wherein said washer has an elliptical shape including a wider arc and a narrower arc, and said corner regions are at transition regions between said wider arc and said narrower arc.

13. A washer as in claim 1, wherein said washer has a rectangular shape and said corner regions are each generally triangular with a rounded external corner.

14. A large-area rectangular washer for roofing and insulation applications, comprising:

a planar surface area defining an entire perimeter of said washer and having a central aperture for inserting a fastener therethrough, a pair of imaginary orthogonal axes centered at said aperture and dividing said surface area into imaginary quadrants;

stiffeners including at least one of reinforcing indentations, elevations, beads, and ribs on said washer surface area, said stiffeners being one of generally straight and generally ovoid;

said stiffeners defining corner regions disposed radially outside said stiffeners relative to said aperture, at least one said corner region being in each said quadrant, when said washer is stressed said corner regions bend elastically about an imaginary line that is at acute angles to said axes of said washer surface area, and when said stiffener is straight said imaginary line being generally parallel to an associated straight stiffener to define a generally triangular corner, and when said stiffener is generally ovoid said imaginary line is generally tangent to an associated ovoid stiffener that defines said corner region.

15. A washer as in claim 14, wherein meshing elements to increase friction are located in said corner regions and within a closed periphery formed of at least one of said stiffeners.

16. A large-area generally ovoid washer for roofing and insulation applications, comprising:

a planar surface area defining an entire perimeter of said washer and having a central aperture for inserting a fastener therethrough, a pair of imaginary orthogonal axes centered at said aperture and dividing said surface area into imaginary quadrants;

stiffeners including at least one of reinforcing indentations, elevations, beads, and ribs on said washer surface area, said stiffeners being substantially straight;

said stiffeners defining generally chordal segment corner regions disposed radially outside said stiffeners relative to said aperture, said corner regions being segments of said ovoid washer, at least one said corner region being in each said quadrant, when said washer is stressed after installation each said corner region bends elastically about an imaginary chord line that is at acute angles to said axes of said washer surface area and being generally parallel to an associated straight stiffener that defines said chordal-segment corner region.

17. A washer as in claim 16, wherein meshing elements to increase friction are located in said corner regions and within a closed periphery formed of at least one of said stiffeners.

* * * * *